US005100022A

United States Patent [19]

Fukudome et al.

[11] Patent Number: 5,100,022

[45] Date of Patent: Mar. 31, 1992

[54] SHEET CONTAINER AND SHEET DISPENSER APPARATUS

[75] Inventors: Yoshio Fukudome, Ibaraki; Koji Iwasaki, Niigata, both of Japan

[73] Assignee: Hitachi, Ltd., Tokyo, Japan

[21] Appl. No.: 731,667

[22] Filed: Jul. 17, 1991

[30] Foreign Application Priority Data

Jul. 23, 1990 [JP] Japan ..... 2-194184

[51] Int. Cl.[5] ..... B65H 1/02

[52] U.S. Cl. ..... 221/198; 221/287; 271/149; 902/16

[58] Field of Search ..... 221/197, 198, 287; 271/145, 147, 149, 160, 162, 163; 902/16, 17

[56] References Cited

U.S. PATENT DOCUMENTS

| | | | |
|---|---|---|---|
| 3,790,161 | 2/1974 | Ericsson | 271/162 X |
| 4,423,826 | 1/1984 | Hirata et al. | 221/198 X |
| 4,619,388 | 10/1986 | Ono et al. | 271/145 X |
| 4,958,825 | 9/1990 | Onomoto et al. | 271/149 X |

*Primary Examiner*—Joseph E. Valenza
*Assistant Examiner*—Dean A. Reichard
*Attorney, Agent, or Firm*—Antonelli, Terry, Stout & Kraus

[57] ABSTRACT

A sheet container is detachably attached to a sheet dispenser mechanism. A stack of sheets stored in the sheet container are taken out by take-out rollers and introduced into nip sections defined between feed rollers and frictional separation rollers which are opposed to and pressedly contacted with the feed rollers, and the stack of sheets are separated from one another to be delivered. The take-out rollers and the feed rollers are provided in the sheet dispenser mechanism, while the frictional separation rollers are provided in the sheet container. The sheet container includes a front plate which determines the position of the front part of the stack of sheets therewithin, and a lower end portion of the front plate is formed with projections which protrude toward the stack of sheets. The projections restrict the position of the lower end portion of the front part of the stack of sheets in the nip sections between the feed rollers and the frictional separation rollers. The projections are located substantially between the axes of the take-out rollers and the feed rollers which are projected through the front plate toward the stack of sheets when the sheet container is attached to the sheet dispenser mechanism, and the height of the projections from the front plate is lower than that of a tangent line connecting the outer peripheries of the take-out rollers and the feed rollers which are projected through the front plate.

5 Claims, 6 Drawing Sheets

SHEET CONTAINER AND SHEET DISPENSER APPARATUS

BACKGROUND OF THE INVENTION

The present invention relates to a sheet dispenser apparatus such as an automated teller machine and, more particularly, to a sheet container and a sheet dispenser apparatus which are light-weight and simplified in structure and which can be produced at a low cost.

Japanese Patent Unexamined Publication No. 61-12535 discloses a structure in which a sheet container includes a whole mechanism for sheet separation. In this structure, means such as gears are necessary for transmitting a separation driving force from a main body of a sheet dispenser mechanism to the sheet container, and an electromagnetic clutch is required for switching the driving force, resulting in a problem that the weight and the price of the sheet container are increased.

Further, Japanese Utility Model Unexamined Publication No. 62-144844 discloses a structure in which a sheet separation mechanism is provided in a sheet dispenser apparatus at the outside of a sheet container, while a sheet delivery mechanism is provided in the sheet container. In this structure, when the sheet container is attached to or detached from a main body of an apparatus, the operation changes a condition of contact between the lower end portion of a stack of sheets and frictional separation means so that two or more sheets of paper may be delivered at once or that it may become impossible to send a sheet of paper out of the container, resulting in difficulty of making the performance reliable. Besides, since the sheet delivery mechanism is provided in the sheet container, there are problems that means for transmitting a driving force from the main body of the apparatus are necessary, and that the weight of the container itself is increased.

SUMMARY OF THE INVENTION

An object of the present invention is to provide a sheet container and a sheet dispenser apparatus which are light-weight, simplified in structure, and reduced in cost and which enable a favorable sheet feeding operation.

In order to achieve the above object, the invention provides a sheet container to be detachably attached to a sheet dispenser mechanism of an automated teller machine or the like including a sheet separation mechanism in which sheets stored in the sheet container are taken out by take-out rollers and introduced into nip sections defined between feed rollers and frictional separation rollers which are opposed to and pressedly separated from one another to be delivered, wherein the take-out rollers and the feed rollers of the sheet separation mechanism are provided in the sheet dispenser mechanism, while the frictional separation rollers are provided in a main body of the sheet container, and a front plate which determines the position of the front part of a stack of sheets within the main body of the container is formed with projections which restrict the position of the lower end portion of the front part of a stack of sheets in the nip sections.

Further, the invention provides a sheet container to be detachably attached to a sheet dispenser mechanism of an automated teller machine or the like including a sheet separation mechanism in which a stack of sheets stored in the sheet container are taken out by take-out rollers and introduced into nip sections defined between feed rollers and frictional separation rollers which are opposed to and pressedly contacted with the feed rollers, and the sheets are separated from one another to be delivered, wherein the take-out rollers and the feed rollers of the sheet separation mechanism are provided in the sheet dispenser mechanism, while the frictional separation rollers are provided in a main body of the sheet container, and a front plate which determines the position of the front part of the stack of sheets within the main body of the container is formed with projections on the side of the stack of sheets, the projections being located substantially between the axes of the take-out rollers and the feed rollers which are projected through the front plate toward the stack of sheets when the main body of the container is attached to the sheet dispenser mechanism, the height of the projections from the front plate being lower than that of a tangent line connecting the outer peripheries of the take-out rollers and the feed rollers when the main body of the container is attached to the sheet dispenser mechanism.

Moreover, the invention provides a sheet dispenser apparatus in which a sheet container is detachably attached to a sheet dispenser mechanism so that a stack of sheets stored in the sheet container are taken out by take-out rollers and introduced into nip sections defined between feed rollers and frictional separation rollers which are opposed to and pressedly contacted with the feed rollers, and the sheets are separated from one another to be delivered, wherein the take-out rollers and the feed rollers are provided in the sheet dispenser mechanism, while the frictional separation rollers are provided in the sheet container, and a front plate which determines the position of the front part of the stack of sheets within the sheet container is formed with projections which restrict the position of the lower end portion of the front part of the stack of sheets in the nip sections.

Furthermore, the invention provides a sheet dispenser apparatus in which a sheet container is detachably attached to a sheet dispenser mechanism so that a stack of sheets stored in the sheet container are taken out by take-out rollers and introduced into nip sections defined between feed rollers and frictional separation rollers which are opposed to and pressedly contacted with the feed rollers, and the sheets are separated from one another to be delivered, wherein the take-out rollers and the feed rollers are provided in the sheet dispenser mechanism, while the frictional separation rollers are provided in the sheet container, and a front plate which determines the position of the front part of the stack of sheets within the sheet container is formed with projections on the side of the stack of sheets, the projections being located substantially between the axes of the take-out rollers and the feed rollers which are projected through the front plate toward the stack of sheets when the sheet container is attached to the sheet dispenser mechanism, the height of the projections from the front plate being lower than that of a tangent line connecting the outer peripheries of the take-out rollers and the feed rollers when the main body of the container is attached to the sheet dispenser mechanism.

DESCRIPTION OF THE PREFERRED EMBODIMENTS

Figure 1:
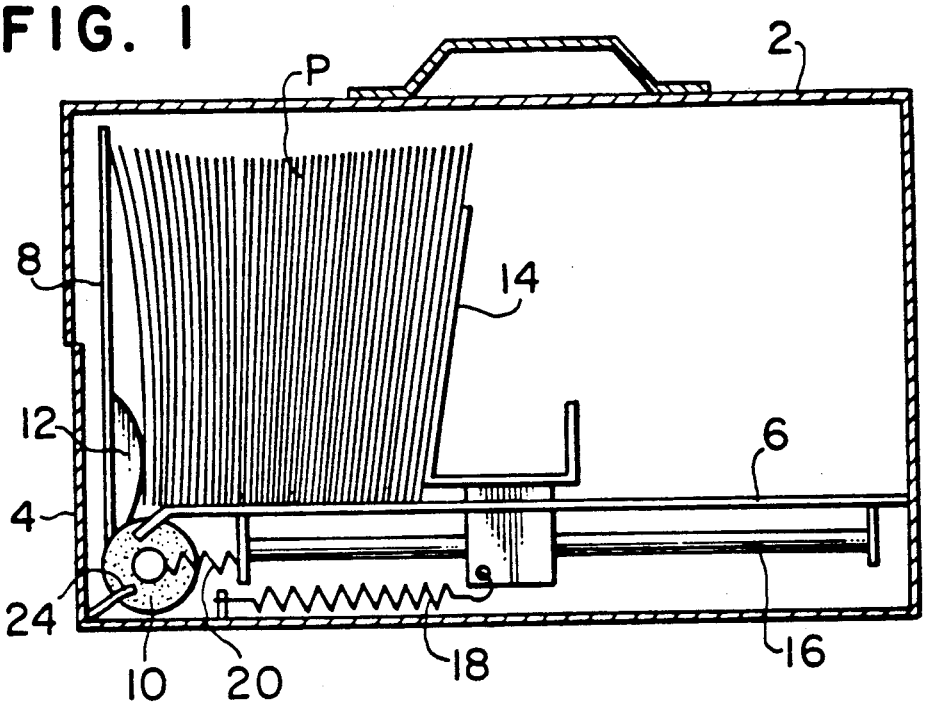
FIG. 1 is a vertical cross-sectional view of a sheet or paper container according to one embodiment of the present invention.

FIG. 1 illustrates a sheet or paper container 2 according to one embodiment of the present invention. Its outer covering includes a vertically movable shutter 4 to open the container. At the inside of the container, there are provided a bottom plate 6 for carrying a stack of sheets or paper P, a front plate 8, a plurality of smoothly curved projections 12 formed at the lower end of the front plate 8, and a pressing plate 14 for advancing the stack of sheets P toward the front plate 8. Gate rollers 10 serving as frictional separation means include one-way clutches so that these gate rollers will rotate not in a direction of sheet delivery but in its opposite direction, with springs 20 causing the gate rollers 10 to be opposed to and contacted with feed rollers 22 which function as feed means. A guide 24 serves to help each sheet of paper to be smoothly delivered to a main body of a sheet dispenser mechanism when it is taken out from the stack of sheets P. The projections 12 restrict a lower end portion of the stack of sheets P in the same condition as when the gate rollers 10 are separated from the front plate 8. The pressing plate 14 is guided by a rod 16, and a spring force of a spring 18 is exerted on this pressing plate.

Figure 2:
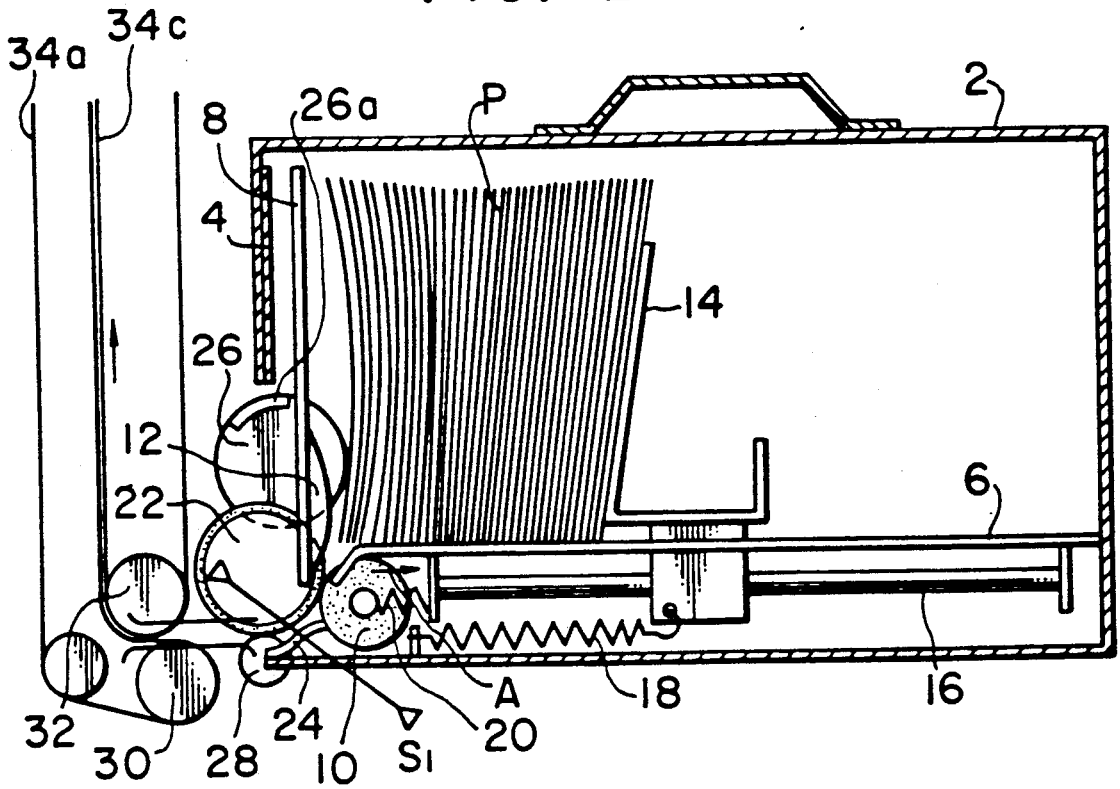
FIG. 2 is a view of the sheet container of FIG. 1 when it is attached to a sheet dispenser mechanism.

FIG. 2 illustrates a state of the sheet container 2 shown in FIG. 1 when it is attached to the main body of the sheet dispenser mechanism. When the sheet container 2 is attached to a separation mechanism on the side of the main body of the sheet dispenser mechanism, the shutter 4 is first moved upwardly and opened by an opening/closing mechanism (not shown). Next, pick-up rollers 26 serving as paper taking-out means of the separation mechanism on the side of the main body of the sheet dispenser mechanism and the feed rollers 22 serving as paper feed means enter into the sheet container 2, so that the feed rollers 22 will be opposed to and contacted with the gate rollers 10 while pressing them backwardly in a direction indicated by an arrow A until the engagement is completed at a certain position. In this case, the above-mentioned projections 12 maintain the lower end portion of the front part of the stack of sheets P in a condition suitable for sheet separation.

Further, the projections 12 are arranged to have a height smaller than a distance between the front plate 8 and a tangent line connecting the outer periphery of the pick-up roller 26 and that of the feed roller 22 so as not to offer frictional resistance against the delivery when each sheet of paper is taken out. The pick-up rollers 26 are each provided with a member 26*a* of a material such as rubber having a high frictional coefficient on a portion of the outer peripheral surface thereof so that sheets of paper will be taken rollers 22 in cooperation with the gate rollers 10 separate the sheets from one another when they are taken out by the pick-up rollers 26. After that, each sheet is held between the feed rollers 22 and pinch rollers 28 and transferred to belts 34*a*, 34*c* which are respectively extended over pulleys 30, 32 on the downstream side. Here, the gate rollers 10 are prevented from rotating in the delivery direction by the one-way clutches (not shown), the surfaces thereof being made of a material having a high frictional coefficient.

Figure 3:
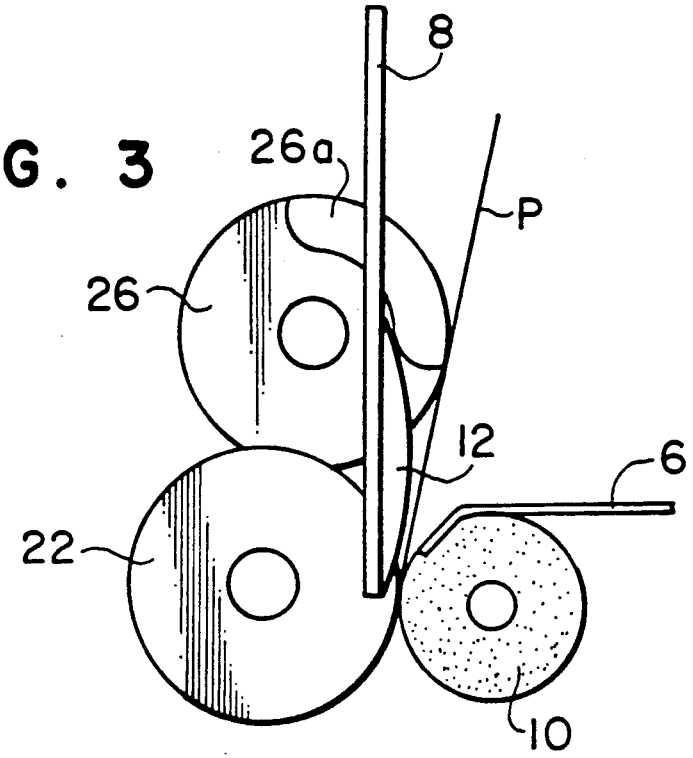
FIG. 3 is an enlarged view of a portion of FIG. 2.

FIG. 3 illustrates the positional relation of the projections 12 with respect to the pick-up roller 26, the feed roller 22, and the gate roller 10, more specifically.

Figure 4:
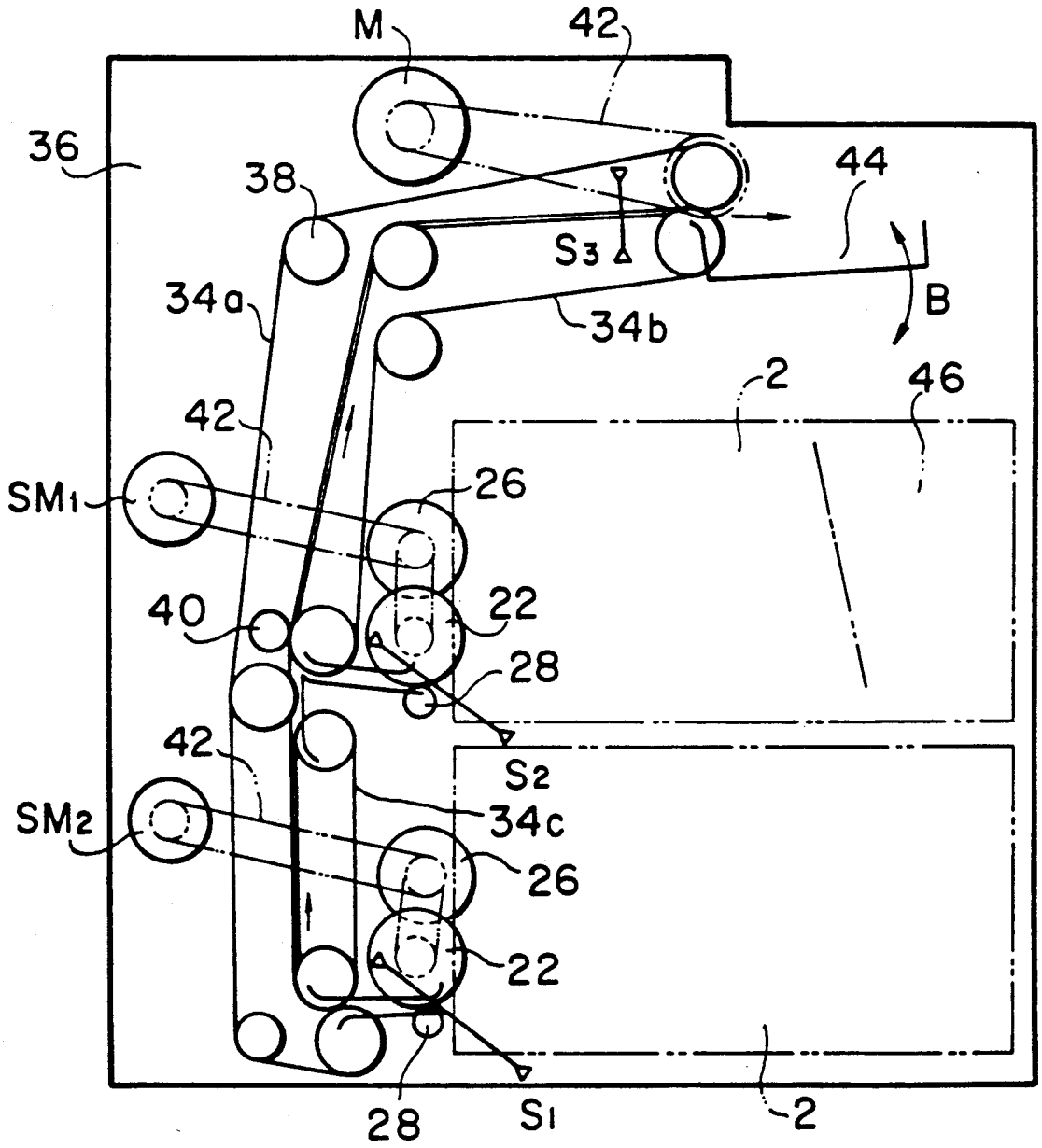
FIG. 4 is a schematic view of the sheet dispenser mechanism.

FIG. 4 illustrates a main body of a sheet dispenser mechanism 36 to which the present invention is applied. The main body of the sheet dispenser mechanism 36 is provided with upper and lower sheet containers 2, feed rollers 22 serving as separation mechanisms, pick-up rollers 26, motors $SM_1$ and $SM_2$ for driving the separation mechanisms, belt means 34 for the sheet delivery, a plurality of pulleys 38 over which three belts 34*a*, 34*b* and 34*c* having different lengths are extended, a plural-sheets detector 40 which detects two or more sheets of paper being taken out from the separation mechanisms, a motor M for driving the belts 34, timing belts 42, and a collecting section 44 in which the delivered sheets of paper are accumulated orderly.

As for the operation, the motors $SM_1$ and $SM_2$ can rotate in both normal and reverse directions, and they rotate in the normal direction when each sheet of paper is separated from the stack of sheets P. Then, each sheet from the stack of sheets P which has been held between the feed rollers 22 and the pinch rollers 28 is delivered between the belts 34i'a and 34*c* or 34*b*. If any sheets intercept a light beam toward a sensor $S_1$ or $S_2$ at a location downstream of the separation mechanism, the motor $SM_1$ or $SM_2$ rotates in the reverse direction to return the sheets to the sheet container 2. When the plural-sheets detector 40 detects more than one sheet, the collecting section 44 is rotated in a direction indicated by an arrow B, and sheets accumulated in the collecting section 44 are returned to a recovery section 46 of the sheet container 2. Reference characters $S_1$, $S_2$ and $S_3$ denote sensors for detecting the numbers of sheets.

Figure 5:
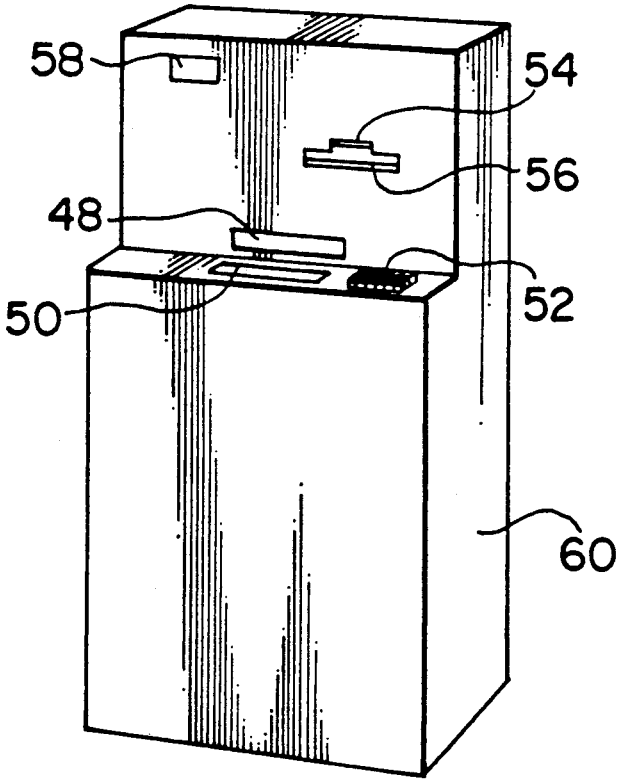
FIG. 5 is a perspective view of an automated teller machine.

FIG. 5 illustrates an appearance of an automated teller machine 60 to which the above-described main body of the sheet dispenser mechanism 36 is applied. The apparatus 60 is provided with a dispensing opening 48 where sheets of paper in the collecting section 44 of the main body of the sheet dispenser mechanism 36 are dispensed, an operational instruction indicating section 50, operation buttons 52, a card inlet 54, a specification slip dispensing opening 56, a customer's information indicating section 58 where operable transaction items are indicated, and so forth.

Figure 6:
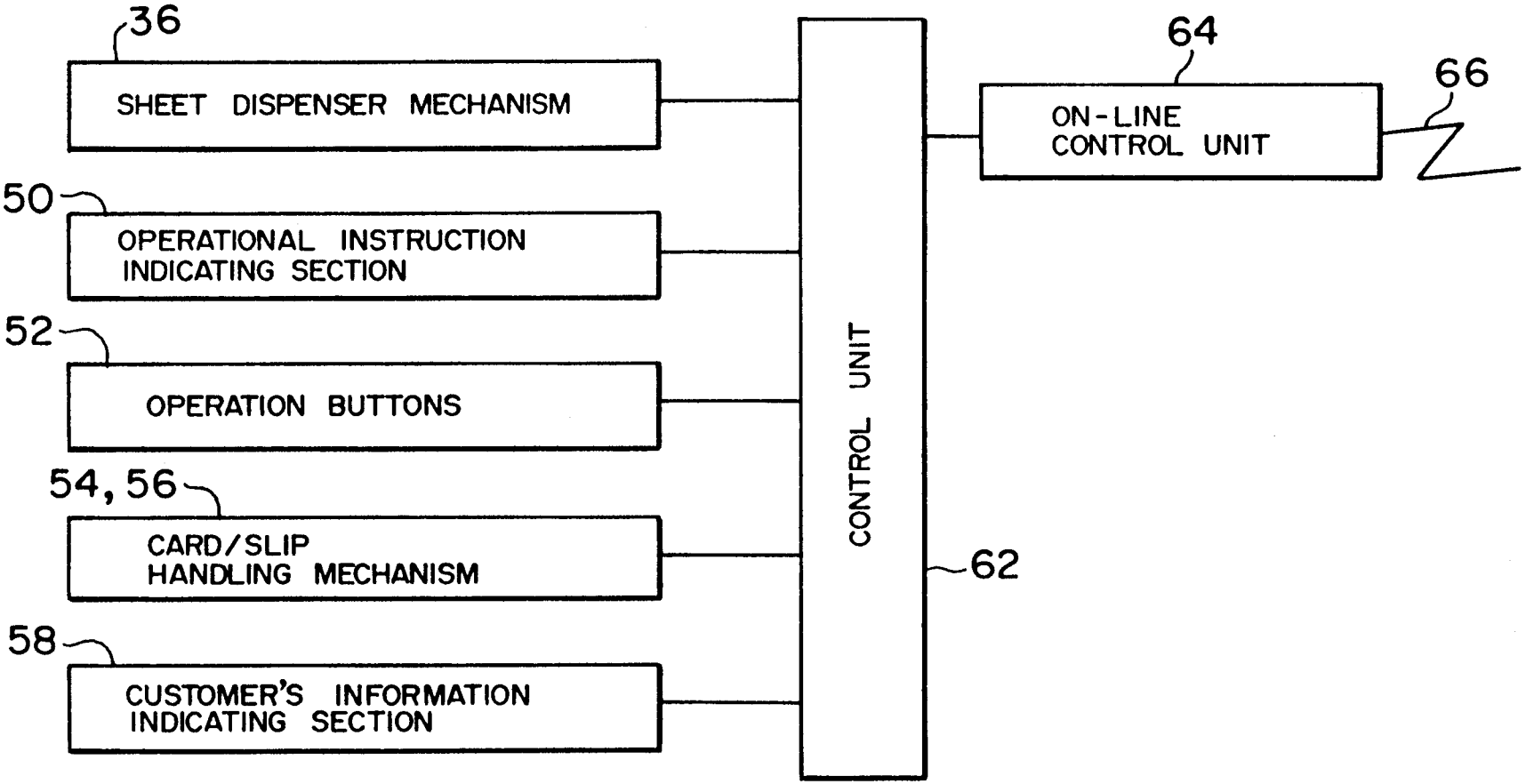
FIG. 6 is a diagram showing an internal structure of the apparatus shown in FIG. 5.

FIG. 6 illustrates the internal structure of the automated teller machine 60 shown in FIG. 5. The component parts illustrated in FIG. 5 are individually connected to a control unit 62, and controlled by it to carry out a transaction.

An on-line control unit 64 is connected with the control unit 62, and the on-line control unit 64 communicates with a host processing device (not shown) through a communication line 66.

Figure 7:
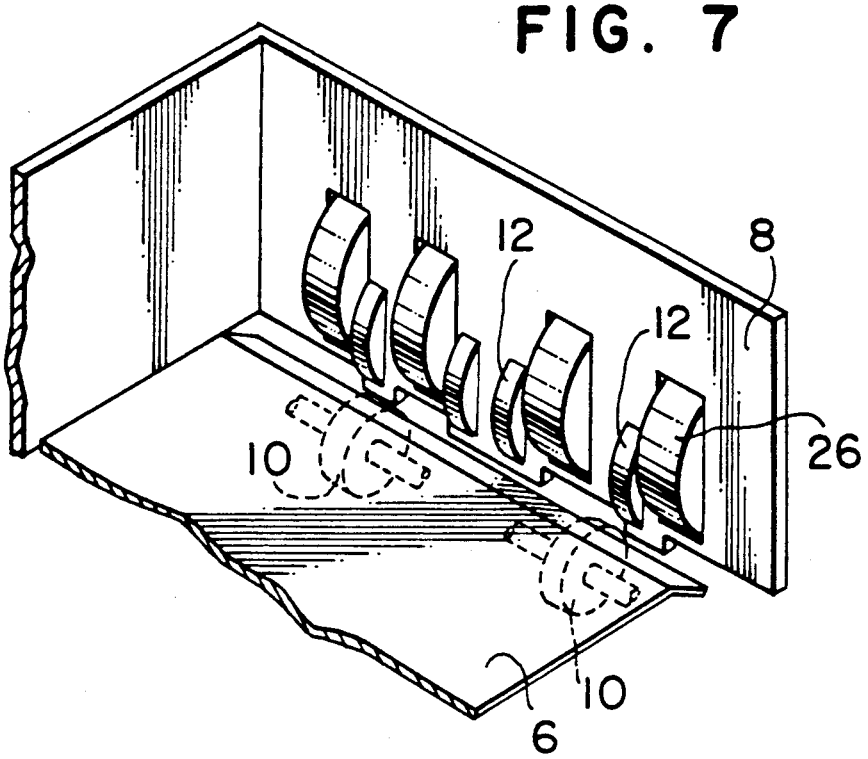
FIG. 7 is a broken-away perspective view showing the inside of the sheet container of FIG. 1.

FIG. 7 illustrates the positional relation of the front plate 8, the plurality of smoothly curved projections 12, the bottom plate 6 and the like of the sheet container 2 shown in FIG. 1. The projections 12 formed on the front plate 8 and the pick-up rollers 26 are separately provided, as shown in FIG. 7, so that their positions will not coincide with those of inherent folds or wrinkles of sheets of paper.

Next, the operation of this embodiment will be explained.

As operator in charge sets a large number of sheets of paper in the sheet container 2 as shown in FIG. 1. In this case, such a stack of sheets P is pressed against the front plate 8 by the pressing plate 14, while the smoothly curved projections 12 formed on the lower end portion of the front plate 8 constantly maintain the lower end portion of the front part of the stack of sheets P in a uniform state along the gate rollers 10 and a bent portion of the front side of the bottom plate 6. The state in which the lower end portion of the stack of sheets P is kept is a condition to perform the separation of each sheet from the stack of sheets P favorably. When the sheet container 2 is attached to the main body of the sheet dispenser mechanism 36 in such a manner as to bring the stack of sheets P into the above-described state, the shutter 4 is first upwardly and opened, and the pick-up rollers 26 and the feed rollers 22 enter into the sheet container 2 without interference. The feed rollers 22 begin to be opposed to and contacted with the gate rollers 10 in the course of this entering operation. Since the gate rollers 10 are biased toward the feed rollers 22 by the springs 20, the pressure of the opposed contact between the sheet container 2 and the feed rollers 22 can be constantly maintained at a predetermined value irrespective of the amount of wear of the gate rollers 10. At this stage, the pick-up rollers 26 are also opposed to and contacted with the front of the stack of sheets P so as to press the stack of sheets P slightly backwardly. Moreover, as described above, the plurality of smoothly curved projections 12 formed on the lower end portion of the front plate 8 serve to previously maintain the lower end portion of the front part of the stack of sheets P under the predetermined condition which will not be influenced whether the pick-up rollers 26 and the feed rollers 22 enter or not. Consequently, the positional relation of the pick-up rollers 26, the feed rollers 22, the gate rollers 10, the front bent portion of the bottom plate 6, the front plate 8 and the plurality of smoothly curved projections 12 with respect to the stack of sheets P can be constantly kept in the optimum state for separation of the sheets. When two sheet containers 2 are attached to the sheet dispenser mechanism 36 one above the other, the automated teller machine 60 is brought into a waiting condition for transaction.

After inserting a card into the card inlet 54 of the automated teller machine 60 in the waiting condition, a customer inputs the desired sum of money to be dispensed according to instructions in the operational instruction indicating section 50. In response to the input by the customer, the control unit 62 functions so that sheets of the number in accordance with the desired sum will be sent out of the upper and lower sheet containers 2 of the main body of the sheet dispenser mechanism 36 shown in FIG. 4.

Sending a sheet out of the lower sheet container 2 shown in FIG. 4 will now be described.

In response to a command from the control unit 62, the motor $SM_2$ for driving the separation mechanism rotates until taking out a certain number of sheets is completed, and the sheets are delivered to a delivery line one by one from the stack of sheets P which is contacted with the pick-up rollers 26 by the pressing plate 14, and accumulated in the collecting section 44. If two or more sheets are delivered at once as a result of the taking-out operation by the separation mechanism, the plural-sheets detector 40 detects this, and after finishing the taking-out operation by the separation mechanism, the sheets in the collecting section 44 which do not correspond to the desired sum of money input by the customer are all returned to the recovery section 46 of the upper sheet container 2 by rotating the collecting section 44.

On the other hand, when the taking-out operation is accurately performed by the separation mechanism, the sheets accumulated in the accumulation section 44 are pushed into the dispensing opening 48 (FIG. 5), and then, the customer takes these sheets while taking a card specification slip or the like from the other dispensing opening as well, thus completing the transaction.

The separation mechanism conducts one-by-one separation in the following manner. The pick-up rollers 26, which are contacted with the stack of sheets P, and the feed rollers 22 are connected to each of the separation mechanism motors $SM_1$, $SM_2$ by the timing belts 42, as shown in FIG. 4, and when these motors rotate, sheets of paper begin to be taken out. First, the pick-up rollers 26 function such that the members **26*a* having a high frictional coefficient formed on the outer peripheral surfaces thereof send the sheets to nip sections between the feed rollers 22 and the gate rollers 10. Owing to a difference between a frictional coefficient of the rotating feed rollers 22 and a frictional coefficient of the material having a high frictional coefficient on the surfaces of the gate rollers 10 which do not rotate in the delivery direction but stop and are engaged to the feed rollers 22 by a predetermined pressing force, the sheets sent to the nip sections are separated from one another without fail. The separated sheets are passed to the pinch rollers 28 one by one, fed to the delivery lines on the downstream side, and accumulated in the collecting section 44**.

The sheets which are taken out one by one by the separation mechanisms are detected by the sensors $S_1$, $S_2$ and $S_3$. After the separation mechanisms complete the taking-out operation of the sheets, if any sheets intercept the light beam toward the sensor $S_1$ or $S_2$, the motor $SM_1$ or $SM_2$ causes the pick-up rollers 26 and the feed rollers 22 to rotate in the reverse direction at low speed so as to return the sheets to the sheet container 2.

When the sheet container 2 is detached from the main body of the sheet dispenser mechanism 36, the gate rollers 10 are slightly displaced toward the feed rollers 22 by the pressing force of the springs 20, contrary to the attaching operation described previously, and the shutter 4 is closed so that the sheet will not be escaped out of the sheet container 2, and that the lower end portion of the front part of the stack of sheets P is kept at a certain position by the plurality of smoothly curved projections 12, thereby completing the operation.

Figure 8:
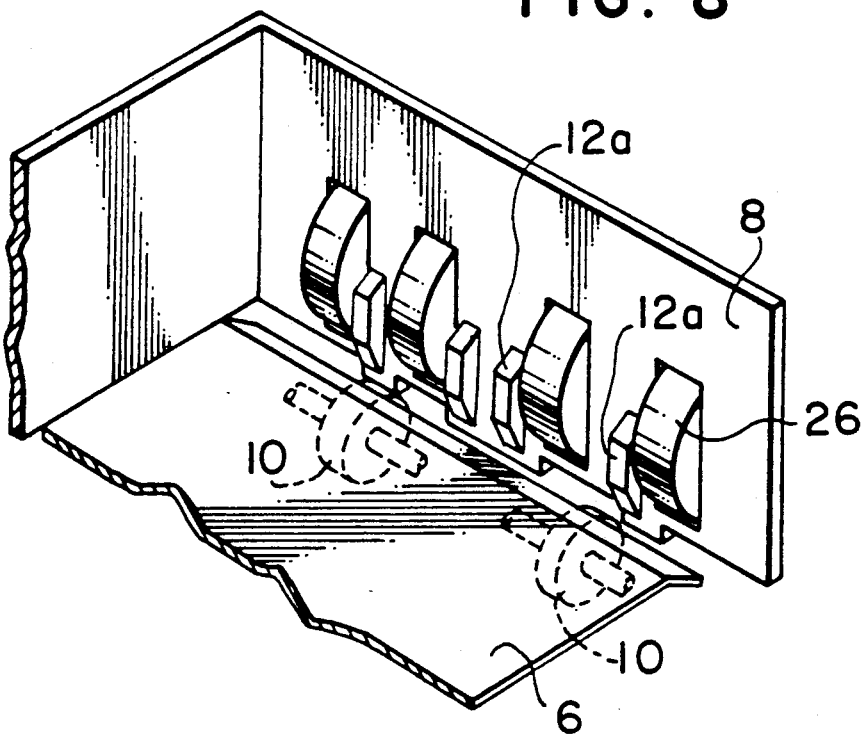
FIGS. 8, 9 and 10 are perspective views of other embodiments, each showing a modification of projections.

FIG. 8 illustrates a configuration of projections **12*a* according to another embodiment of the invention. These projections 12*a* with smooth surfaces can be formed by partially press-bending the front plate 8, or integrally formed with the front plate 8 by plastic molding, or formed by adhering, screw-fastening or press-fitting each projection piece or a plurality of projection pieces to the front plate 8**.

Figure 9:
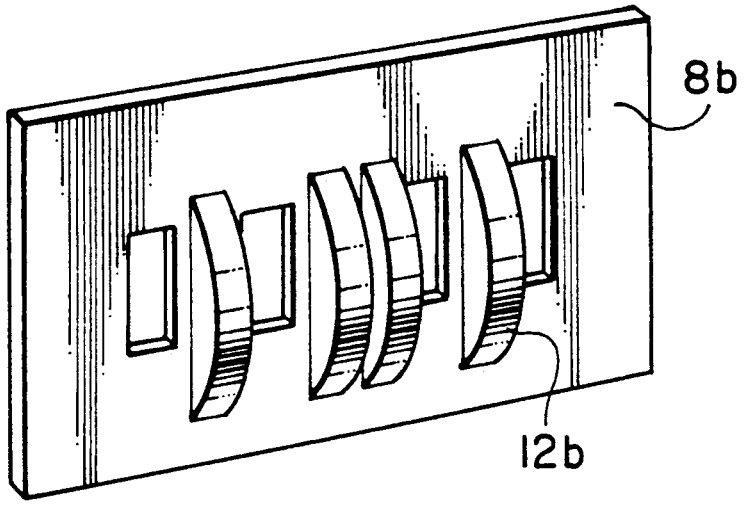
Figure 10:
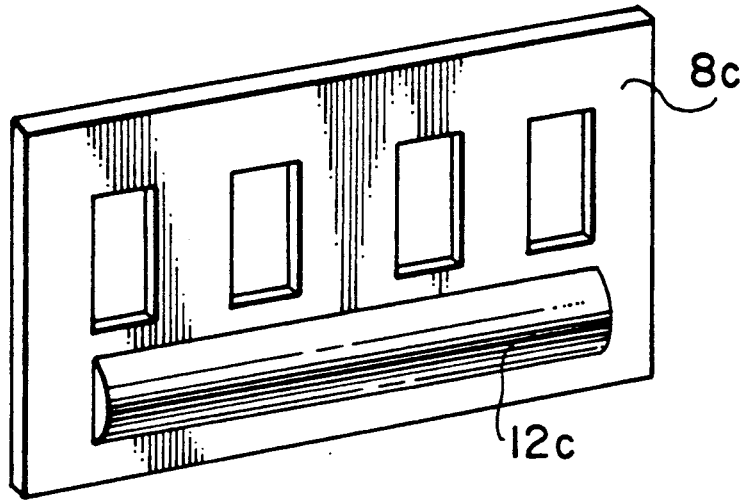

Other embodiments of modified projections are shown in FIGS. 9 and 10. FIG. 9 illustrates projections 12*b* which extend as far as the level above the pick-up rollers 26. FIG. 10 illustrates a semicylindrically shaped projection 12*c* which is formed in one portion of the front plate 8. Since each sheet container requires only one member, the cost can be decreased.

According to the present invention, as described heretofore, only the rollers serving as frictional separation means of the separation mechanism are provided in the sheet container so that the sheet container can be reduced in weight to lessen the labor when the operator in charge carries it, and sheets of paper and the like can be stored in the container in an unaffected condition whether the sheet container is attached to or detached from the sheet dispenser mechanism, thus producing the apparatus having a reliable separation performance at a low cost.

What is claimed is:

1. A sheet container to be detachably attached to a sheet dispenser mechanism of an automated teller machine or the like including a sheet separation mechanism in which a stack of sheets stored in said sheet container are taken out by take-out rollers and introduced into nip sections defined between feed rollers and frictional separation rollers which are opposed to and pressedly contacted with said feed rollers, and the sheets are separated from one another to be delivered, wherein said take-out rollers and said feed rollers of said sheet separation mechanism are provided in said sheet dispenser mechanism, while said frictional separation rollers are provided in a main body of said sheet container, and a front plate which determines the position of the front part of the stack of sheets within the main body of said container is formed with projections which restrict the position of the lower end portion of the front part of said stack of sheets in said nip sections.

2. A sheet container to be detachably attached to a sheet dispenser mechanism of an automated teller machine or the like including a sheet separation mechansim in which a stack of sheets stored in said sheet container are taken out by take-out rollers and introduced into nip sections defined between feed rollers and frictional separation rollers which are rollers, and the sheets are separated from one another to be delivered, wherein said take-out rollers and said feed rollers of said sheet separation mechanism are in said sheet dispenser mechanism, while said frictional separation rollers are provided in a main body of said sheet container, and a front plate which determines the position of the front part of the stack of sheets within the main body of said container is formed with projections on the side of said stack of sheets, said projections being located substantially between the axes of said take-out rollers and said feed rollers which are projected through said front plate toward said stack of sheets when the main body of said container is attached to the sheet dispenser mechanism, the height of said projections from said front plate being lower than that of a tangent line connecting the outer peripheries of said take-out rollers and said feed rollers when the main body of said container is attached to the sheet dispenser mechanism.

3. A sheet dispenser apparatus in which a sheet container is detachably attached to a sheet dispenser mechanism so that a stack of sheets stored in said sheet container are taken out by take-out rollers and introduced into nip sections defined between feed rollers and frictional separation rollers which are opposed to and pressedly contacted with said feed rollers, and the sheets are separated from one another to be delivered, wherein said take-out rollers and said feed rollers are provided in said sheet dispenser mechansim, while said frictional separation rollers are provided in said sheet container, and a front plate which determines the position of the front part of the stack of sheets within said sheet container is formed with projections which restrict the position of the lower end portion of the front part of said stack of sheets in said nip sections.

4. A sheet dispenser apparatus in which a sheet container is detachably attached to a sheet dispenser mechanism so that a stack of sheets stored in said sheet container are taken out by take-out rollers and introduced into nip sections defined between feed rollers and frictional separation rollers which are opposed to and pressedly contacted with said feed rollers, and the sheets are separated from one another to be delivered, wherein said take-out rollers and said feed rollers are provided in said sheet dispenser mechanism, while said frictional separation rollers are provided in said sheet container, and a front plate which determines the position of the front part of the stack of sheets within said sheet container is formed with projections on the side of said stack of sheets, said projections being located substantially between the axes of said take-out rollers and said feed rollers which are projected through said front plate toward said stack of sheets when said sheet container is attached to the sheet dispenser mechanism, the height of said projections from said front plate being lower than that of a tangent line connecting the outer peripheries of said take-out rollers and said feed rollers when the main body of said container is attached to the sheet dispenser mechanism.

5. An automated teller machine according to claim 3 or 4, wherein said sheets are paper money.

* * * * *